US005529203A

United States Patent [19]

Flaugher

[11] Patent Number: 5,529,203

[45] Date of Patent: Jun. 25, 1996

[54] DESICCANT CONTAINER HAVING CAP RETAINING NIB SEGMENTS

[75] Inventor: David Flaugher, Beavercreek, Ohio

[73] Assignee: Stanhope Products Company, Brookville, Ohio

[21] Appl. No.: 396,732

[22] Filed: Mar. 1, 1995

[51] Int. Cl.[6] ..... B65D 39/00

[52] U.S. Cl. ..... 220/306; 220/87.1; 220/307; 220/506

[58] Field of Search ..... 220/87.1, 306, 220/307, 352, 353, 356, 506, 555

[56] References Cited

U.S. PATENT DOCUMENTS

| | | | |
|---|---|---|---|
| 1,657,927 | 1/1928 | Heinzen | 220/506 X |
| 1,973,717 | 9/1934 | Kessenich | 220/506 X |
| 2,139,792 | 12/1938 | Bechaud | 220/506 X |
| 2,148,770 | 2/1939 | Mittendorf | 210/131 |
| 2,325,657 | 8/1943 | Burkness | 210/134 |
| 2,887,117 | 5/1959 | Rosholt | 220/306 X |
| 3,071,800 | 1/1963 | Patriquin | 220/306 X |
| 3,212,416 | 10/1965 | Boersma | 220/352 X |
| 3,262,599 | 7/1966 | Muller | 220/307 |
| 3,360,156 | 12/1967 | Bohlman | 220/306 |
| 3,545,227 | 12/1970 | Grahl | 62/474 |
| 3,879,292 | 4/1975 | McClive | 210/282 |
| 3,918,578 | 11/1975 | Cullen et al. | 206/204 |
| 3,926,599 | 12/1975 | Rudin et al. | 55/387 |
| 4,266,408 | 5/1981 | Krause | 62/474 |
| 4,436,623 | 3/1984 | Cullen et al. | 210/282 |
| 4,457,843 | 7/1984 | Cullen et al. | 210/282 |
| 4,623,368 | 11/1986 | Lancesseur | 55/387 |
| 4,921,512 | 5/1990 | Maryyanek et al. | 55/488 |
| 5,038,582 | 8/1991 | Takamatsu | 62/474 |

*Primary Examiner*—Steven M. Pollard
*Attorney, Agent, or Firm*—Biebel & French

[57] ABSTRACT

A container for particulate desiccant comprises a cup and a cap. The cup includes spaced inner and outer wall portions connected by a transverse web portion to define a chamber having an opening. The cap is designed for receipt in the chamber to cover the opening. In addition, the cap has a hole for receiving the inner wall portion of the cup. The outer wall portion includes a number of nib segments which are arranged into axially spaced nib groupings. The nib segments within each of the nib groupings are circumferentially spaced-apart. The cap includes an edge portion which permits the cap to be retained between axially adjacent nib groupings thus retaining the cap within the chamber in one of a number of axially spaced positions.

12 Claims, 3 Drawing Sheets

DESICCANT CONTAINER HAVING CAP RETAINING NIB SEGMENTS

BACKGROUND OF THE INVENTION

1. Field of the Invention

This invention relates to desiccant containers for use in air or fluid dryers of automotive air conditioning systems, and more particularly, it relates to a desiccant container having locking nibs which permit a cap to be retained in one of a number of axially spaced positions to prevent particulate desiccant from shifting within the container.

2. Description of Related Art

Desiccants are commonly used in automotive air conditioning systems for dehydrating air and refrigerants. Particulate desiccants are common in such systems because the high surface area-to-volume ratios of the particles facilitates the interaction of the particles with surrounding air or fluid. Since the particles of desiccant must be held in the air or fluid stream and prevented from contaminating other parts of the system, the particles must be held in a container which is permeable to the air or fluid but impermeable to the particles.

One form of dryer used in automotive air conditioning systems includes an elongated receiver or accumulator canister having inlet and outlet ports communicating with the interior of the canister. A desiccant container is positioned in the interior of the canister and allows for air and/or fluid through the desiccant material.

One form of package-type desiccant container for use in an accumulator or receiver dryer is constructed from synthetic felted wool or polyester which is filled with desiccant and then sealed by stitching or fusing. One drawback to this form of package is that the felted bag may not conform to the shape of the canister, so that air or fluid may bypass the desiccant. Another drawback is that the bag may be non-uniform in shape, thereby making automatic assembly of the dryer difficult.

If felted polyester is used as a less expensive substitute for felted wool, the seams of the bag may be formed by ultrasonic welding. Unfortunately, the reliability of such ultrasonic welds is questionable and the bag may open up, allowing adsorbent material to escape from the bag and potentially contaminate the system. In addition, the felted polyester bag is vulnerable to burn-through when the dryer is welded shut.

In another proposed form of an accumulator or receiver dryer, particulate desiccant is trapped between a pair of grids or plates which are welded or press fit inside the canister. According to one embodiment, the desiccant is charged by pouring the desiccant particles into the canister once a first of the grids or plates is positioned. A pipe extends through holes in the grids or plates to exhaust dried air to an outlet port.

A dryer of this form is likely to be difficult to assemble because the grids or plates must be slid into position and, in some cases, welded inside the canister. Further, since the desiccant particles are manually poured into the canister, the desiccant must be pre-measured due to the difficulty of controlling the amount of desiccant poured into the canister based on visual observation alone. The pouring of the desiccant creates a risk of accidental contamination outside the accumulator since desiccant particles may fall into the pipe communicating with the outlet port. Nevertheless, the amount of desiccant poured into the canister may vary from canister to canister for at least the reasons mentioned above.

Copending patent application Ser. No. 08/235, 283, assigned to the same assignee of the present invention, discloses a two-piece desiccant container which can be inserted within an accumulator or receiver dryer. The desiccant container includes a cup for holding particulate desiccant and a cap which is locked to the cup by an integral detent on an inner wall portion of the cup.

The particulate desiccant is either poured directly into the cup, or a felted bag containing particulate desiccant is inserted into the cup before the desiccant container is inserted within the receiver dryer. In both cases, the amount of desiccant placed within the cup is critical to whether or not the particulate desiccant can shift within the cup once the cap is locked in place. That is, the cup and cap cooperate to define a chamber having a predetermined fixed volume. If there is not enough particulate desiccant to fill the predetermined volume, or if the desiccant should settle over time, then the particulate desiccant within the container will undesirably shift within chamber.

SUMMARY OF THE INVENTION

These drawbacks and others are overcome by means of the present invention embodied in a container for a particulate desiccant.

The desiccant container includes a cup member extending along an axis and having spaced inner and outer wall portions connected by a transverse web portion to define a chamber having an opening, and a cap for receipt in the chamber. The cap has a hole for receiving the inner wall portion when the cap is received in the chamber. The desiccant container also includes a plurality of nib segments projecting radially inwardly from the outer wall portion which engage and retain the cap in one of a number of axially spaced positions to prevent shifting of the particulate desiccant within the chamber.

Shifting of the charged desiccant within the chamber is prevented by urging the cap over the nib segments until the cap abuts the desiccant material within the chamber. The cap is lockingly retained into abutment with the desiccant material by engaging the nib segments positioned axially adjacent the cap.

Both the transverse web portion and the cap are perforated to allow air or fluid to reach the desiccant housed thereon. The container includes first and second plies of permeable lining material which trap the particulate desiccant in the container.

Therefore, it is one object of the invention to provide a desiccant package which is simple to assemble, and prevents the shifting of desiccant with the chamber thereof. This and other objects, features and advantages of the present invention will be described in further detail in connection with preferred embodiments of the invention shown in the accompanying drawings, wherein:

DETAILED DESCRIPTION OF THE PREFERRED EMBODIMENTS

FIGS. 1–4 illustrate a desiccant container 10 for holding desiccant particles or beads 12 (FIG. 3A) which comprises a generally cylindrically cross-sectioned cup 14 and a cap 16.

Figure 3A:
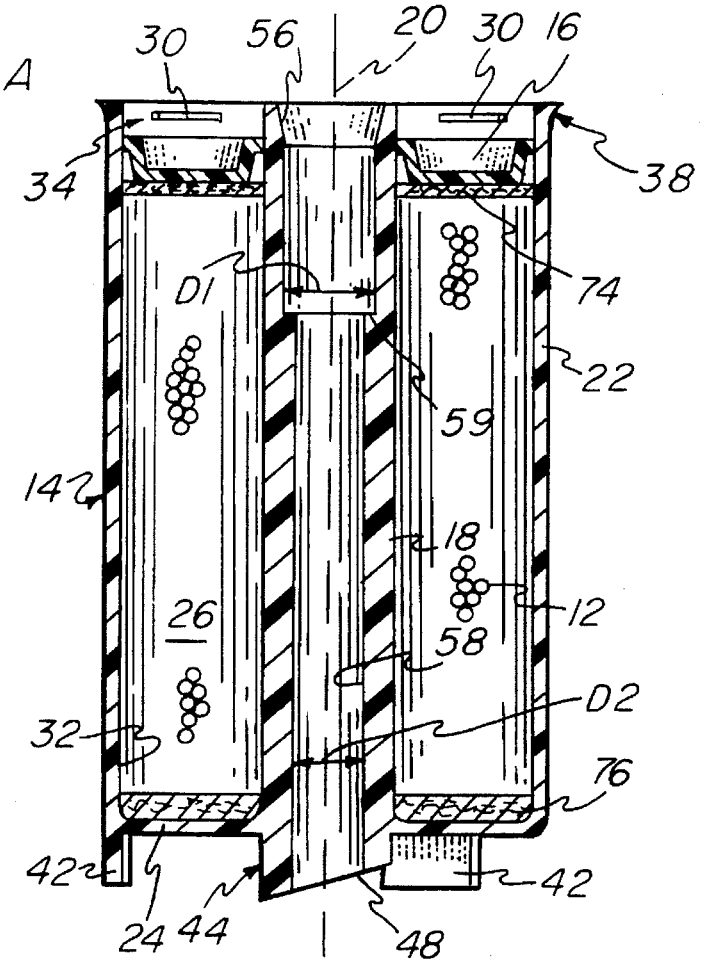
FIG. 3A is a cross-sectional view of the desiccant container taken along the line 3A—3A in FIG. 2B.

As best seen in FIG. 3A, the cup 14 is a one-piece plastic molding which includes a cylindrical inner wall portion 18 extending along a central axis 20, a cylindrical outer wall portion 22 concentric with the inner wall portion 18, and a bottom defined by a transverse wall or web portion 24 which joins the inner wall portion 18 to the outer wall portion 22. The inner and outer wall portions 18, 22 and the transverse web portion 24 cooperate to define a chamber 26 having an opening 28 (FIG. 1) for receiving the desiccant 12.

The cylindrical outer wall portion 22 includes a plurality of axially and circumferentially spaced-apart beads or nib segments 30 (FIG. 2A) projecting radially inwardly from an inner surface 32 of the outer wall portion 22. The plurality of nib segments 30 are arranged into four axially spaced-apart groupings 34 (FIG. 3B) proximate a cap side of the container 10. The nib segments 30 within each grouping 34 are oriented in a common plane which extends transverse to the central axis 20. Further, the nib segments 30 within each grouping 34 are circumferentially spaced-apart by approximately 45°. As discussed further below, the nib segments 30 permit the cap 16 to be retained within the chamber 26 in the tightest possible location in order to reduce or prevent movement or shifting of the particulate desiccant 12 within the chamber 26.

The outer wall portion 22 also includes an outwardly flared lip portion 38. The flared lip portion 38 is adapted to resiliently fit within a dryer canister 40 (FIG. 5) of an air conditioning or refrigeration system not shown. Thus, the desiccant container 10 is retained within the dryer canister 40 by means of a friction or interference fit provided by the flared lip portion 38. The lip portion 38 also serves as a continuous annular seal to prevent air or fluid escape that may otherwise occur along the interface between the circumference of the cup 14 and the dryer canister 40.

Figure 4:
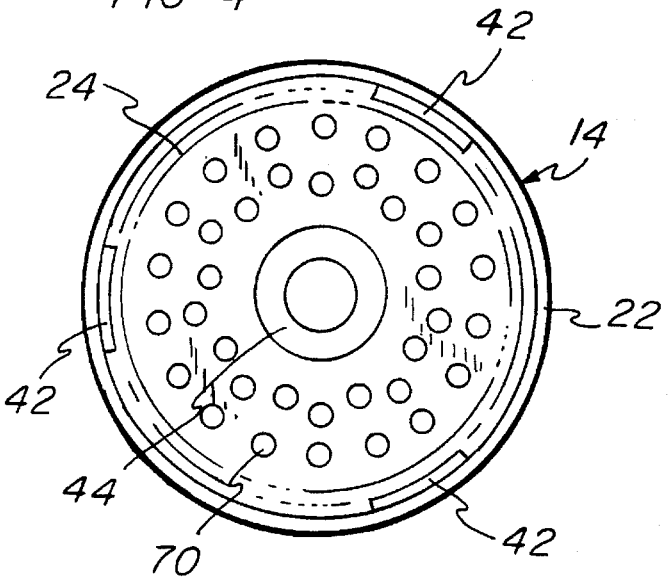
FIG. 4 is a bottom plan view of the desiccant container of FIG. 1.

The transverse web portion 24 includes a plurality of circumferentially spaced-apart arcuate spacer elements or legs 42 and a central inner wall extension portion 44. In the preferred embodiment, there are three legs spaced approximately 120° apart which extend axially from a peripheral edge of the transverse web portion 24 radially adjacent the outer wall portion 22 (FIG. 4). The legs 42 maintain the desiccant container 10 at a predetermined distance away from a closed end portion 46 of the dryer canister 40 as discussed further below.

The inner wall extension portion 44 is coaxially joined to and communicates with the inner wall portion 18 at a web side of the container 10. The extension portion 44 has a tapered free end 48 which tapers toward the closed end portion 46 of the canister 40 to facilitate the return of the dried air or fluid to the air conditioning or refrigeration system.

The inner wall portion 18 serves as a sleeve for receiving a portion of an aluminum pipe or conduit 54 (FIG. 5) which communicates with an outlet port (not shown) of the air conditioning or refrigeration system. The inner wall portion 18 includes a beveled inner end surface 56 at the cap side thereof. The beveled inner end surface 56 tapers radially inwardly in a direction toward the transverse web portion 24 to facilitate insertion of the aluminum pipe or conduit 54.

The inner wall portion 18 also includes a stepped inner surface 58 which defines an intermediate shoulder or flange 59. Thus, the stepped inner surface 58 has two inner diameters $D_1$ and $D_2$, wherein $D_1>D_2$. The inner diameter $D_1$ is substantially equal to or slightly larger than the outer diameter of the aluminum pipe or conduit 54. The aluminum pipe or conduit 54, when inserted into the inner wall portion 18, abuts against the shoulder 59 to urge the desiccant container 10 downwardly within the dryer canister 40. Further, the inner wall portion 18, inner wall extension portion 44, and aluminum pipe or conduit 54 cooperate to define a continuous axially extending passage 50 for returning the dried air or fluid to the air conditioning or refrigeration system not shown. Since a portion of the passage 50 is formed by the inner wall portion 18 and inner wall extension portion 44, the amount of aluminum tubing or conduit 54 required to complete the passage 50 is desirably reduced thereby providing cost reductions.

Figure 1:
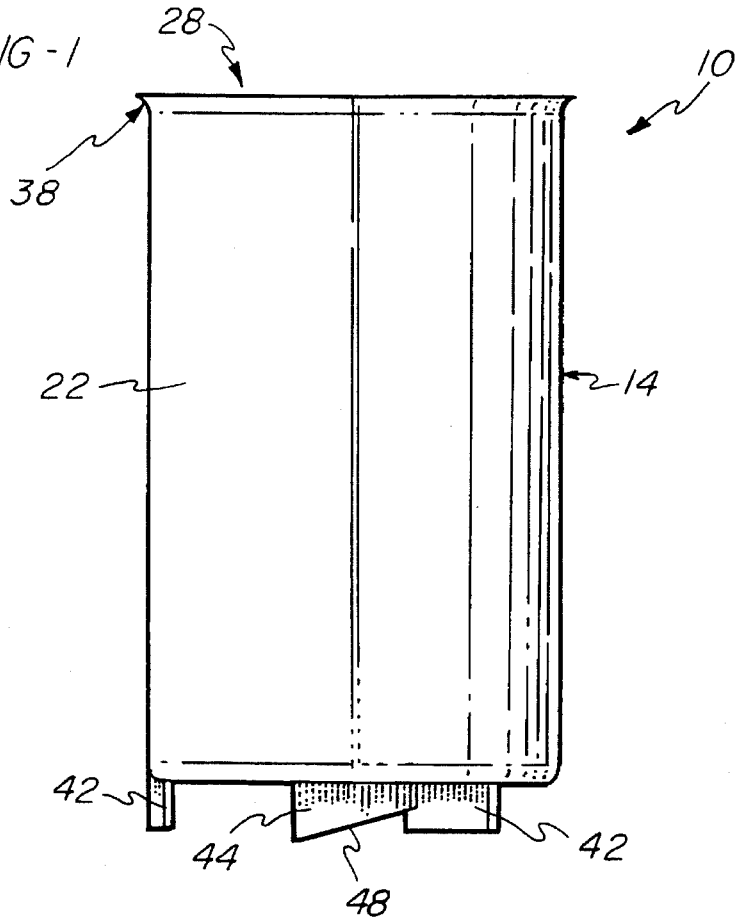
FIG. 1 is a front elevational view of a desiccant container of the present invention.
Figure 2A:
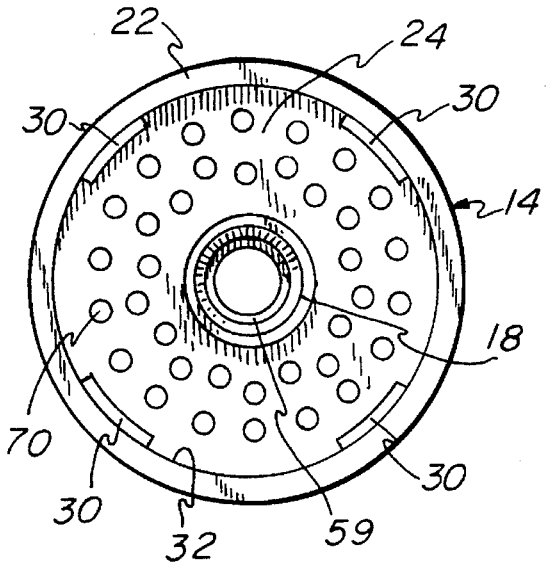
FIG. 2A is a top plan view of the desiccant container of FIG. 1 without the cap installed.
Figure 2B:
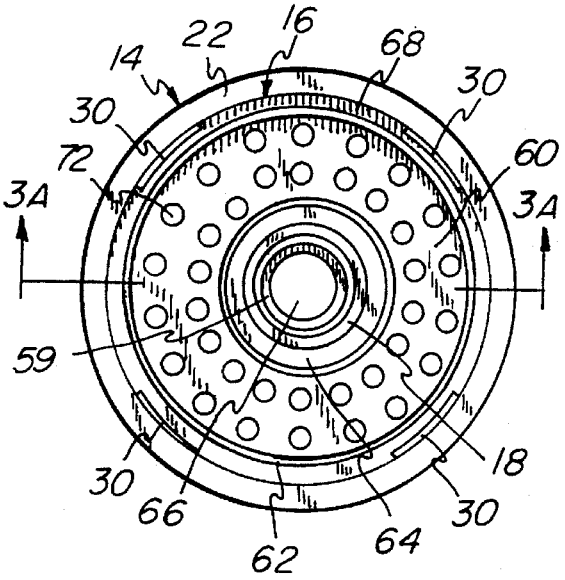
FIG. 2B is a top plan view of the desiccant container of FIG. 1 with the cap installed.
Figure 5:
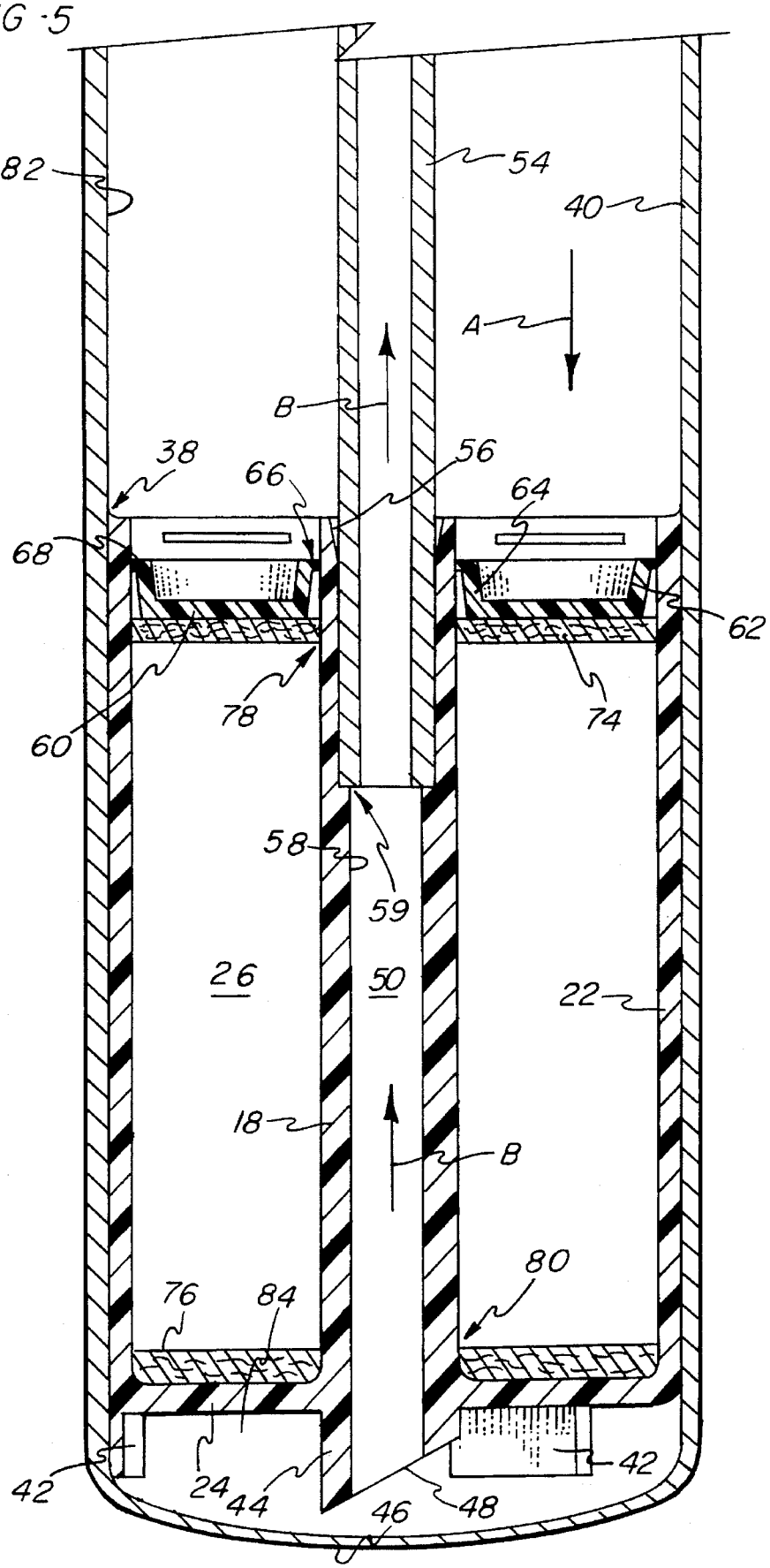
FIG. 5 is a cross-sectional view of the desiccant container of FIG. 1 installed in a canister of an accumulator or receiver dryer.

As best shown in FIGS. 2B and 5, the cap 16 conforms to the circular shape of the cup 14. The cap 16 includes an intermediate planar portion 60, a peripheral flanged portion 62 extending transversely from an outer circumference of the intermediate planar portion 60, and a central flanged portion 64 extending transversely from an inner circumference of the intermediate planar portion 60. A hole 66 extends through the central flanged portion 64 for receiving the inner wall portion 18 of the cup 14 in an assembled state.

Figure 3B:
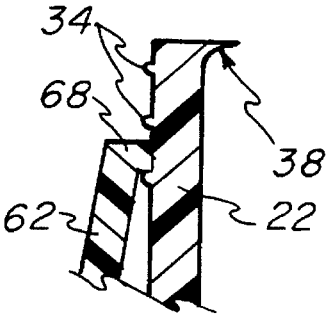
FIG. 3B is an enlarged sectional view of cap being retained between adjacent nib groupings of the cup.

The peripheral flanged portion 62 includes an edge portion 68 which cooperates with the nib groupings 34 to positively lock the cap 16 to the cup 14 as shown in FIG. 3B. That is, the outer diameter of the edge portion 68 is greater than the inner diameter of the nib groupings 34. Further, the edge portion 68 has an axial thickness which is less than the axial spacing between adjacent nib groupings 34 so that the edge portion 68 can be positively retained between axially adjacent nib groupings 34.

The cap 16 is sufficiently resilient so that when the cap 16 is attached or detached from the cup 14, the edge portion 68 will pass over the nib groupings 34 when sufficient force applied to the cap 16. In the preferred embodiment, the edge portion 68 is circumferentially continuous. However, the edge portion 68 could be circumferentially intermittent if desired.

The transverse web portion 24 of the cup 14 and the intermediate planar portion 60 of the cap 16 are each perforated with a number of symmetrically arranged ports or perforations (one of each shown at 70 and 72 in FIGS. 2A and 2B, respectively) so that the intermediate planar portion 60 and the transverse web portion 24 are each permeable to the air or fluid to be dried. In the example shown, the ports 70, 72 are arranged in concentric annular rows such that the two inner rows have nine ports each and the outer row has eighteen ports. The precise arrangement of the ports is not critical to the operation of the desiccant container 10 as long as the desiccant 12 remains contained and air or fluid (not shown) is allowed to enter the container 10, interact evenly with the desiccant 12 and exhaust from the container 10.

As shown in FIG. 3A, plies 74, 76 of a permeable lining material such as felted polyester or gauze are placed inside the chamber 26 near the transverse web portion 24 and the cap 16 to trap the desiccant 12 in the container 10. The lining material must be permeable to the air or fluid (not shown) to be dried but impermeable to the particulate desiccant 12. If gauze is used, the mesh size of the gauze must be significantly smaller than the grain size of the desiccant. While the plies 74, 76 are shown as circular liners or pads having central holes 78, 80 embracing and surrounding the inner wall portion 18, the plies may also be separate plies of a permeable capsule or pouch (not shown), such as a torroidal capsule shaped to surround the inner wall portion 18.

One method for fabricating the desiccant container 10 includes the step of casting or injection molding the cup 14 to form a one-piece plastic member having the inner and outer wall portions 18, 22 connected by the transverse web portion 24. One plastic suited for use in casting the cup 14 is polypropylene. Polyethylene may also be used but is not preferred. The cap 16 is likewise cast from plastic.

When the desiccant container is charged with the particulate desiccant 12, the first ply 76 of the permeable lining material is inserted by sliding it down the inner wall portion 18 until positioned adjacent the transverse web portion 24. The desiccant 12 is then charged into the chamber 26, as by pouring. Since the chamber 26 is torroidal and relatively shallow, the height of the desiccant 12 in the chamber 26 can be seen through the opening 28 so that the proper amount of desiccant 12 is charged in a manual operation. Once the desiccant 12 is charged, the second ply 74 of the permeable lining material is slid down the inner wall portion 18 against the desiccant 12.

The cap 16 is then inserted into the chamber 26 such that the inner wall portion 18 extends through the central hole 66 in the cap 16. As the cap 16 is urged downwardly toward the transverse web portion 24, the edge portion 68 of the cap 16 passes radially inwardly over the axially spaced nib groupings 34 until the intermediate planar portion 60 of the cap 16 abuts against the charged desiccant 12. In a locked state, the cap 16 abuts against the second ply 74 and charged desiccant 12 while the edge portion 68 thereof is lockingly retained by at least one nib grouping 34.

Depending upon the specific amount of desiccant 12 contained in the chamber 26, the edge portion 68 may be lockingly retained between axially adjacent nib groupings 34, or the edge portion 68 may abut against a nib grouping 34 positioned axially adjacent the edge portion 68 in the cap side direction.

Once the desiccant container 10 is assembled, it can then be inserted into a dryer canister 40 as shown in FIG. 5. The outwardly flared lip portion 38 resiliently bears against an inside surface 82 of the dryer canister 40 to provide a snug fit of the desiccant container 10 in the dryer canister 40. The lip portion 38 also serves to prevent air or fluid from bypassing the desiccant container 10 so as to ensure passage thereof through the chamber 26 and over the desiccant particles 12.

The aluminum pipe or conduit 54 is inserted into the inner wall portion 18 until the pipe 54 abuts against the shoulder 59. The desiccant container is then urged downwardly into the canister 40 until the legs 42 abut against the closed end portion 46 of the canister 40. The legs 42 maintain the transverse web portion 24 at a predetermined distance away from the closed end portion 46 of the dryer canister 40. The legs 42, in cooperation with the closed end portion 46, define a reservoir 84 for the dried air or fluid which has passed through the desiccant 12.

In operation, the air or fluid to be dried passes over the desiccant 12 in the chamber 26 in the direction shown by Arrow A. The inner wall extension portion 44 serves as an inlet for returning the dried air or fluid from the reservoir 84 to the air conditioning or refrigeration system via the passage 50 in the direction of Arrows B.

The cup 14 may be vibrator or bowl fed to a robotic arm for automatic installation into the dryer canister 40. Furthermore, the plies 74, 76 of lining material are relatively resistant to burn-through in the cup 14 while the dryer canister 40 is being welded (not shown). As stated previously, the cup 14 may be sized to fit snugly in the canister 40 to inhibit bypass flow of air or fluid (not shown) to be dried. The nib groupings 34 for detaining the cap 16 on the cup 14 are highly reliable so that the risk that desiccant will escape and contaminate other parts of the air conditioning or refrigeration system (not shown) is minimized.

Various changes or modifications in the invention described may occur to those skilled in the art without departing from the true spirit or scope of the invention. The above description of preferred embodiments of the invention is intended to be illustrative and not limiting, and it is not intended that the invention be restricted thereto but that it be limited only by the true spirit and scope of the appended claims.

What is claimed is:

1. A container for a particulate desiccant, said container comprising:

an cup member extending along an axis and including spaced inner and outer wall portions connected by a transverse web portion to define a chamber having an opening;

a cap for receipt in said chamber, said cap having a hole for receiving said inner wall portion when said cap is received in said chamber; and a plurality of nib segments projecting radially inwardly from said outer wall portion which engage and retain said cap in one of a plurality of axially spaced positions to prevent shifting of the particulate desiccant within said chamber.

2. The container claimed in claim 1, wherein said nib segments are arranged into a plurality of axially spaced nib groupings.

3. The container claimed in claim 2, wherein said nib segments are arranged into four axially spaced nib groupings.

4. The container claimed in claim 2, wherein said nib segments within each of said nib groupings are oriented in a common plane which extends transverse to said axis.

5. The container claimed in claim 2, wherein said nib segments within each of said nib groupings are circumferentially spaced-apart.

6. The container claimed in claim 2, wherein said nib segments within each of said nib groupings are circumferentially spaced-apart by about 45°.

7. The container claimed in claim 1 wherein said transverse web portion and said cap include perforations therein.

8. The container claimed in claim 1 wherein said inner and outer walls are concentric cylinders.

9. The container claimed in claim 1 wherein said outer wall portion includes a flared lip extending outwardly from said outer wall.

10. The container claimed in claim 1 wherein said inner wall portion defines a sleeve open at either end on different sides of said container.

11. The container claimed in claim 1 including first and second plies of permeable lining material for placement in said chamber to trap the particulate desiccant in the container.

12. A container claimed in claim 1 wherein said cup is a one-piece casting.

* * * * *